United States Patent [19]

Escande

[11] 4,349,968

[45] Sep. 21, 1982

[54] PROCESS AND APPARATUS FOR DRYING MATERIAL

[76] Inventor: Henri Escande, "Favol", Bias, 47300 Villeneuve-sur-Lot, France

[21] Appl. No.: 87,948

[22] Filed: Oct. 25, 1979

[30] Foreign Application Priority Data

Oct. 26, 1978 [FR] France ..... 78 31001

[51] Int. Cl.[3] ..... F26B 3/04; F26B 13/06

[52] U.S. Cl. ..... 34/13; 34/31; 34/47; 34/66; 34/203

[58] Field of Search ..... 34/62, 66, 67, 205, 34/207, 208, 20, 13, 47, 34, 31, 203; 98/38 B, 38 D

[56] References Cited

U.S. PATENT DOCUMENTS

| | | | |
|---|---|---|---|
| 525,572 | 9/1894 | Andrae | 34/66 |
| 1,553,296 | 9/1925 | Beard | 34/66 |
| 2,109,704 | 3/1938 | Morrill | 34/66 |
| 4,196,527 | 4/1980 | Escande | 34/203 |
| 4,219,942 | 9/1980 | Coliva | 34/203 |
| 4,242,950 | 1/1981 | Grossmann | 98/38 B |

FOREIGN PATENT DOCUMENTS

| | | | |
|---|---|---|---|
| 1010481 | 6/1957 | Fed. Rep. of Germany | 34/203 |

*Primary Examiner*—Larry I. Schwartz
*Attorney, Agent, or Firm*—Young & Thompson

[57] ABSTRACT

In a drying oven having plural superposed endless belts on which material to be dried, such as fruit, moves in a circuitous path from top to bottom, excessive drying of the material on the lower belts is prevented, by directing hot air toward the upper belts but a mixture of hot air and relatively cool outside air toward the lower belts. Adjustable shutters for the inlet air, and for the division between the two portions of the hot air, are provided, there being separate fans for the two air streams.

6 Claims, 1 Drawing Figure

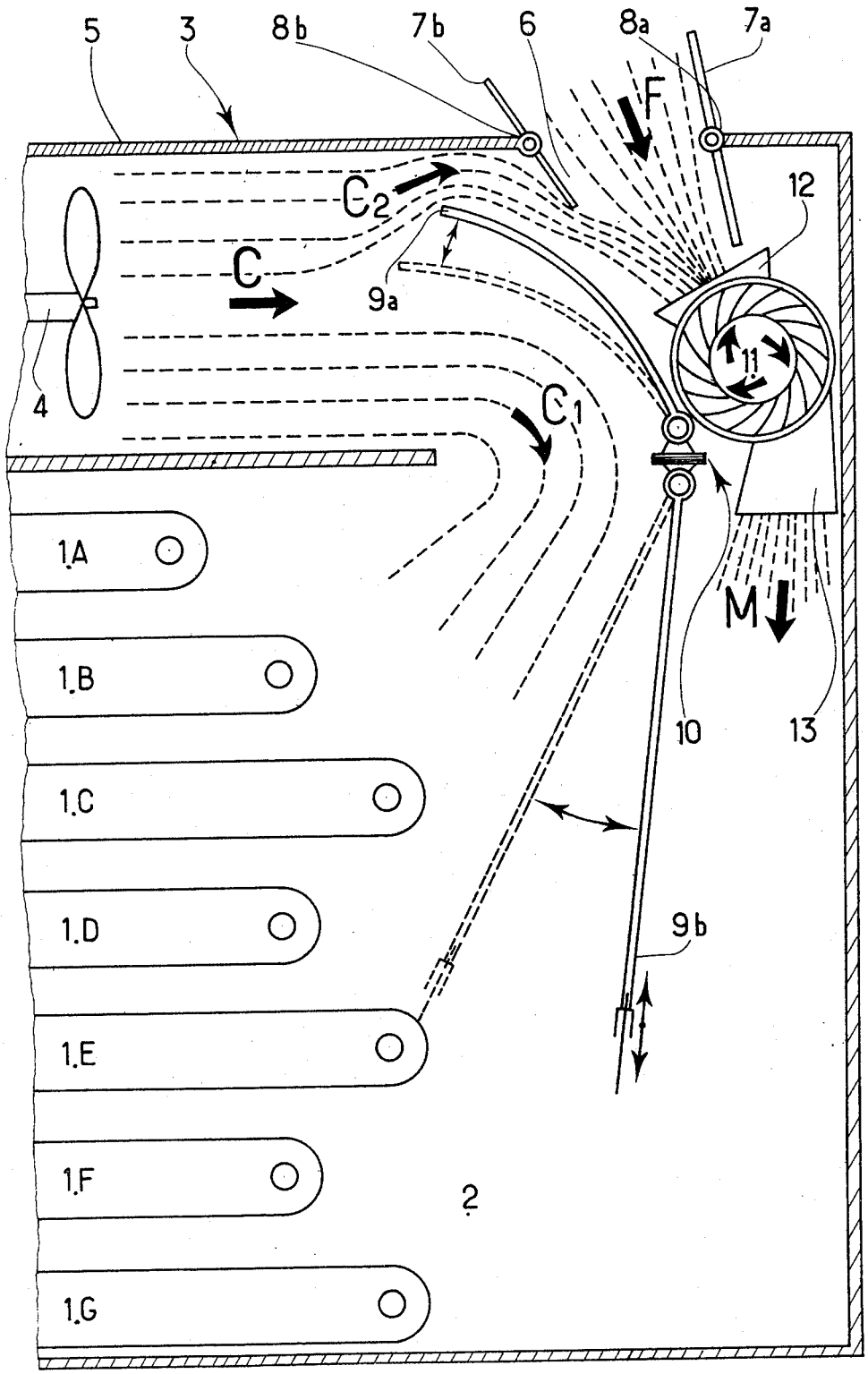
5
3
8b
7b
6
8a
7a
F
12
C2
C
9a
11
4
C1
1.A
1.B
1.C
1.D
1.E
1.F
1.G
M
10
13
9b
2

PROCESS AND APPARATUS FOR DRYING MATERIAL

The present invention relates to drying apparatus as described in my U.S. Pat. No. 4,196,527, constituted by an oven in which products to be treated, especially fruits, circulate on horizontal endless belt conveyors that are superposed and longitudinally swept by currents of hot air generated by an air-blast constituted by a battery of fans disposed in a plane perpendicular to the said belts.

It has been noted that, at the end of the treatment, when the fruits have to circulate on the lower belts, most of them, after losing the greatest part of their retained-water volume, were liable to caramelize because of their high temperature nearly identical to the temperature of the drying fluid circulating in the lower part of the oven.

It is an object of the present invention to provide such a process which regulates the temperature of ventilation inside the said apparatus, conseqently resulting in a repartition of drying temperatures over the whole of the belts.

To this end, the process of the invention is:

first, to provide heat transfer between a volume of hot air coming from the drying apparatus blast and a volume of outer cool air;

then, to guide the flow of the resulting air volume towards the lower belts. The resulting volume of air circulating with a temperature below the temperature of the fluid coming out from the blast, is thus able to provide the final drying of the fruits without the risk of being carmelized.

To practice the process, a mechanism is provided, which comprises an air-inlet disposed at the exit of the said blast and associated with articulated shutters, to regulate ventilation and to direct the circulation of gas inside the oven.

Other objects, features and advantages of the present invention will become apparent from a consideration of the following description, given as a non-limitative example and taken in connection with the accompanying drawing, showing a specific embodiment of a ventilation mechanism, in accordance with the teachings of the process of the invention.

The FIGURE illustrated in the said drawing is a schematic sectional elevation view of part of a drying apparatus, according to the one described in my U.S. Pat. No. 4,196,527 but equipped with such mechanism according to the invention.

The broken lines symbolize the different fluid currents in the drying apparatus, and arrows show the direction of the said currents.

The seven horizontal belts $1_A$, $1_B$, $1_C$, . . . $1_G$ enabling fruit circulation inside the oven 2 and the air mover 3 constituted by a battery of fans 4 arranged in an air duct 5, can be recognized. In such form of preferred realization, the mover 3 is situated above the oven 2.

An inlet 6 for cool air is arranged on the upper side of the air duct 5, and two shutters 7a and 7b, articulated on the axes 8a and 8b respectively, limit the volume of air admitted by the said inlet 6.

It will be noted that deflecting shutters 9a and 9b are mounted which articulate on substantially a single axis 10. The shutter 9b should be preferably adjustable in its length. Both shutters guide and/or regularize the flow of hot air blown by the mover 3, inside the different sectors of the oven 2.

In order to obtain a homogeneous cold air mixture destined to dry the fruits that are on the two last belts ($1_F$, $1_G$), a centrifugal double inlet fan 11 sucks in through an inlet 12, the cool air entering the inlet 6, and part of the hot air from the mover 3, and then forces back, through an outlet 13 directed towards the lower belts, a volume of air whose temperature is lower than the temperature of the fluid coming out of the air duct 5.

The mechanism above described works as follows: the mover 3 produces through the fans 4 a current of hot air (arrow C) the greatest part of which (arrow $C_1$) is directed towards the upper belts ($1_A$, $1_B$, $1_C$, $1_D$, $1_E$) by the orientation of the two shutters 9a and 9b (illustrated with continuous lines) so that the fruits lose the greatest part of their water during the first phase of their drying.

As for the other portion of this current (arrow $C_2$), it is directed towards the inlet 12 of the double inlet fan 11, in order to be mixed with cool air (arrow F) introduced through the inlet 6.

The fan 11 then forces back through the outlet 13, a mixture of cooled air (arrow M) destined to circulate over the fruits brought to the last drying phase on the belts $1_F$ and $1_G$. Note that only the operation of the different shutters 7a, 7b, 9a and 9b is needed to regularize the drying temperatures over the whole belts.

For example:

first, if the shutters 9a and 9b are in the positions illustrated by the dotted lines, the hot air (arrow $C_1$) will circulate along the belts $1_A$, $1_B$, $1_C$, $1_D$ while the mixture of cooled air (arrow M) circulates on the belts $1_E$, $1_F$, $1_G$.

and then, if the inlet 6 is wider, the temperatures of the two fluids moving around the oven 2, will be maintained equal to those obtained when the shutters 9a and 9b are in the initial positions illustrated with continuous lines.

It should be understood that the specific embodiments and steps described in this specification have been presented by way of example rather than limitation, and that various modifications, combinations and substitutions may be effected by those skilled in the art without departure either in spirit or in scope from this invention in its broader aspects and as set forth in the appended claims.

What is claimed is:

1. In a process for drying material in an oven containing a plurality of superposed horizontal endless belts on which the material moves in a circuitous path from top to bottom in the oven; comprising establishing a stream of hot air in the oven, dividing the stream of hot air into first and second portions, directing said first portion toward and along the upper of said belts, mixing the second portion with relatively cool air from outside the oven to form a mixed air stream, and directing said mixed air stream toward the lower of said belts.

2. In apparatus for drying material in an oven containing a plurality of superposed horizontal endless belts on which the material moves in a circuitous path from top to bottom in the oven; the improvement comprising means for establishing a stream of hot air in the oven, means for dividing said stream of hot air into first and second portions, means for directing said first portion toward and along the upper of said belts, means for mixing said second portion with relatively cool air from outside the oven to form a mixed air stream, and means for directing said mixed air stream toward the lower of said belts.

3. Apparatus as claimed in claim 2, and separate fans for said stream of hot air and for said mixed air.

4. Apparatus as claimed in claim 2, and adjustable shutter means within the oven for proportioning said hot air between said first portion and said second portion, said first and second portions flowing on opposite sides of said shutter means.

5. Apparatus as claimed in claim 3, said shutter means comprising a pair of shutters extending in opposite directions from each other and swingable about a substantially common horizontal axis.

6. Apparatus as claimed in claim 3, and means for adjusting the length of said shutter means.

* * * * *